United States Patent [19]

Albertson et al.

[11] Patent Number: 4,475,604

[45] Date of Patent: Oct. 9, 1984

[54] MOBILE MACHINE FOR SUBTERRANEAN INSTALLATION OF PIPING AND THE LIKE

[75] Inventors: Philip E. Albertson; Arthur D. Deken, both of Perry, Okla.

[73] Assignee: The Charles Machine Works, Inc., Perry, Okla.

[21] Appl. No.: 406,552

[22] Filed: Aug. 9, 1982

[51] Int. Cl.[3] ..... E21B 19/14; E21B 3/02

[52] U.S. Cl. ..... 175/85; 175/122; 175/315; 37/80 R; 173/46; 173/164; 254/31; 211/605; 81/57.34

[58] Field of Search ..... 175/52, 85, 170, 315, 175/209, 171, 210; 166/77; 173/164, 166, 46, 149; 81/57.34, 57.16; 24/263 DA; 211/605; 254/31

[56] References Cited

U.S. PATENT DOCUMENTS

| | | | |
|---|---|---|---|
| 732,925 | 7/1903 | Decker | 175/210 |
| 1,239,875 | 9/1917 | Bruce | 254/31 |
| 2,705,614 | 4/1955 | McKibben et al. | 81/57.16 |
| 3,280,920 | 10/1966 | Scott | 175/85 |
| 3,703,111 | 11/1972 | Guier | 81/57.34 |
| 4,149,604 | 4/1979 | Lockwood et al. | 175/315 |
| 4,355,443 | 10/1982 | Blackwell | 24/263 DA |

FOREIGN PATENT DOCUMENTS

| | | | |
|---|---|---|---|
| 252932 | 11/1970 | U.S.S.R. | 173/46 |

*Primary Examiner*—Ernest R. Purser
*Assistant Examiner*—Mark J. DelSignore
*Attorney, Agent, or Firm*—Banner, Birch, McKie & Beckett

[57] ABSTRACT

A ground supported mobile machine appropriate for subterranean installation of piping and the like has a tractor vehicle carrying a trencher driven from the tractor power source, a power operated backfill blade operated from such source to facilitate transporting a tool and drill rod holder, and a vertical drilling attachment powered from the tractor power source; this drilling attachment including a vertical mast providing guide rails for the carriage of a rotary drill head that is reciprocated by a hydraulic actuator along such rails to (1) raise the vehicle to enable positioning stabilizing feet for a vertical drilling operation, (2) manipulate the drill rod and drill bit thereon in performing such a drilling operation, and (3) push piping into the drilled hole upon completion of such drilling operation. A drill table is associated with the vertical mast which carries hydraulically actuated slips to grippingly engage the drill rod to preclude undesired downward rod movement while permitting upward movement of the rod relative to such slips and pipe wrench tongs operable to break free a threaded joint between drill rod sections or a rod section and the drill bit. The drilling attachment further includes a pipe pusher having an upper piping clamp releasably attachable to the drill head carriage to move therewith in pushing piping into the drilled hole and a lower piping clamp releasably attachable to the drill table to guide and hold the piping during the pipe pushing operation.

4 Claims, 16 Drawing Figures

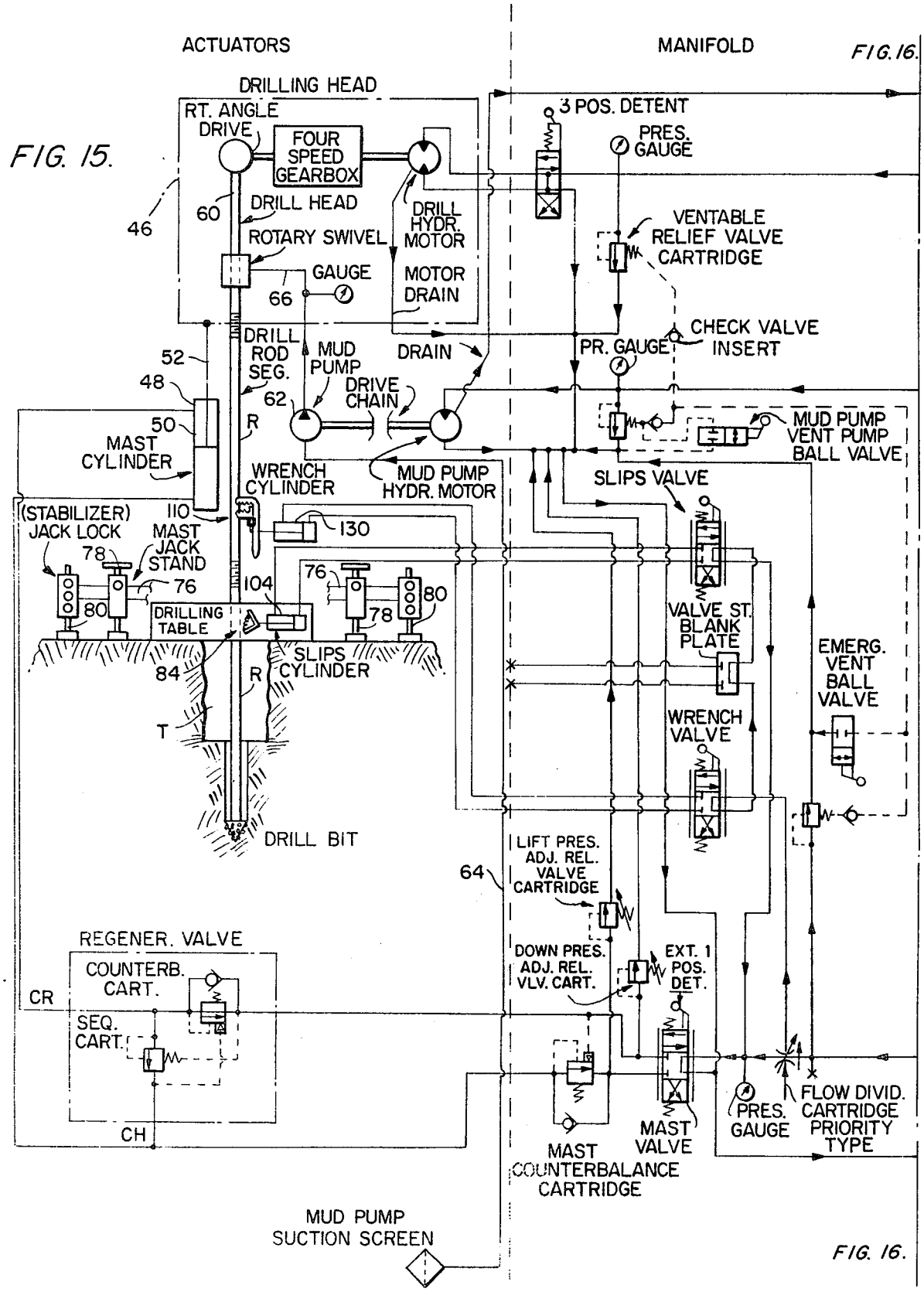
ACTUATORS
MANIFOLD
FIG. 16.
FIG. 15.
DRILLING HEAD
RT. ANGLE DRIVE
FOUR SPEED GEARBOX
DRILL HEAD
ROTARY SWIVEL
DRILL HYDR. MOTOR
MOTOR DRAIN
GAUGE
3 POS. DETENT
PRES. GAUGE
VENTABLE RELIEF VALVE CARTRIDGE
CHECK VALVE INSERT
PR. GAUGE
DRILL ROD SEG.
MUD PUMP
DRAIN
DRIVE CHAIN
MUD PUMP VENT PUMP BALL VALVE
MAST CYLINDER
WRENCH CYLINDER
MUD PUMP HYDR. MOTOR
SLIPS VALVE
(STABILIZER) JACK LOCK
MAST JACK STAND
DRILLING TABLE
SLIPS CYLINDER
VALVE ST. BLANK PLATE
EMERG. VENT BALL VALVE
WRENCH VALVE
DRILL BIT
LIFT PRES. ADJ. REL. VALVE CARTRIDGE
REGENER. VALVE
COUNTERB. CART.
SEQ. CART.
DOWN PRES. ADJ. REL. VLV. CART.
EXT. 1 POS. DET.
MAST VALVE
PRES. GAUGE
FLOW DIVID. CARTRIDGE PRIORITY TYPE
MAST COUNTERBALANCE CARTRIDGE
MUD PUMP SUCTION SCREEN
FIG. 16.

MOBILE MACHINE FOR SUBTERRANEAN INSTALLATION OF PIPING AND THE LIKE

BACKGROUND OF THE INVENTION

This invention relates generally to the field of construction machinery and more particularly to a self propelled mobile machine which is particularly adapted for subterranean installation of piping and the like. The invention is especially concerned with a ground supported mobile machine incorporating a combination of equipment features enabling it to function as a single piece of machinery capable of performing all necessary earth working functions called for in the subterranean installation of piping, tubing, cable, etc.

A number of instances exist where a plurality of earth or ground working operations are required to complete the particular project. To a large extent these several earth working operations such as trenching, earth back filling, vertical hole drilling, etc. have necessitated the utilization of a plurality of separate machinery components to carry out the individual earth working operations in completing the project.

As an example of such a project, greater attention is being given to the energy conservation benefits to be derived from installing closed loop water source heat pumps. For the millions of dwellings utilizing fuel oil, electric or gas heat the attractiveness of utilizing a closed loop water source heat pump is apparent. Whereas installing the pipe loops for the water source heat pump can be carried out horizontally in trenches where there is enough land area at the particular site, many dwelling locations do not have adequate land area available for such horizontal trench installed pipe loops. Thus vertically installed pipe loops in drilled holes of upwards of 110 feet become attractive and a near necessity when land availability surrounding the site for the closed loop water source heat pump is in limited availability.

At the present time, the cost and limitations on drilling equipment availability associated with drilling vertical holes for closed loop water source heat pump systems has forced most of the intending users to install water source heat pump systems concentrating on those applications where horizontal closed loops can be installed. Accordingly, high priority has been placed on developing a mobile machine that would be compact, very manuverable, and capable of efficiently digging the trench for the connecting water lines leading to the heat pump, drilling the hole to accomodate the vertical pipe loop, pushing the piping loop into such hole, and back filling the earth into the trench, etc; carrying out all of these earth or ground working operations that are conventionally performed separately, in a minimum length of time.

Considering the above example which frequently has necessitated utilization of a number of different earth or ground working machines to complete the project, thereby contributing to the cost and length of time necessary to complete the project, the instant invention provides a self contained combination mobile machine. Thereby, the full range of earth working operations needed in installing vertical piping loops employed with water source heat pump systems is made possible at a saving of overall cost and project completion time without the necessity of employing the usual multitude of separate items of earth working machinery.

SUMMARY OF THE INVENTION

A principal object of the present invention is the provision of a ground supported mobile machine appropriate for subterranean installation of piping and the like having the capability as a self contained combination machine to perform such installation with the one machine in a minimum of time and expense to complete the project.

A further primary object of the instant invention is to provide a self propelled mobile machine particularly suited for the earth working operations called for in the installation of either horizontal or vertical piping loops needed for water source heat pumps systems.

A further object is to provide a ground supported mobile machine including a drilling attachment which has a vertical mast carrying a rotary drill head on a carriage that can be reciprocated by a linear hydraulic actuator along the mast to effectively perform the functions of (1) raising the vehicle to enable the positioning of stabilizing feet to carry out a vertical drilling operation (2) manipulating the drill rod and drill bit thereon in performing the rotary drilling operation and (3) pushing piping into the drilled hole upon completion of such drilling operation.

It is also an object of the invention to provide a mobile machine incorporating a drilling attachment as recited in the above object which additionally has a drill table associated with the vertical mast that carries hydraulically actuated slips to grippingly engage the drill rod to keep it from slipping downwardly into an already drilled hole while permitting upward movement of the rod relative to the slips with the drill table additionally having pipe wrench tongs operable to break free a threaded joint between the drill rod sections or a rod section and the drill bit.

Another important object of this invention is the provision of a mobile machine in accordance with the above objects wherein the drilling attachment further includes a pipe pusher having upper and lower piping clamps associated with the rotary drill head carriage and drill table, respectively, to be effective in pushing piping into the drilled hole.

The invention herein achieves the above mentioned objects, aims and purposes by providing a tractor vehicle having a power source to propel the vehicle and a drilling attachment mounted on the vehicle including a vertical mast providing guide rails, a rotary drill head on a carriage reciprocably supported on such guide rails and a linear hydraulic actuator coupled between this mast and carriage to drive the carriage along the rails while the rotary drill head provides a vertical drive shaft to be coupled to a drill rod and bit in performing a vertical rotary drilling operation. The drilling attachment has a drill table fixedly supported adjacent the lower end of the mast which provides an opening to accomodate the drill rod and bit manipulations in performing vertical rotary drilling with the drill table carrying hydraulically actuated slips associated with the opening to grippingly engage with a drill rod and pipe wrench tongs operable to break free a threaded joint between drill rod sections or a rod section and the drill bit.

The mobile machine has a trencher mounted thereon to be driven by the vehicle power source, has a power operated backfill blade mounted thereon to also be operated by this vehicle power source and is provided with a tool and drill rod holder that has hook means engagable with the backfill blade to enable picking up this holder for transportation of tools and drill rod sections on the vehicle between intended project sites.

Finally, a further feature of the combination mobile machine is the provision with the drilling attachment of a pipe pusher which is effectively operated by components on the drilling attachment to move piping clamps relative to each other that can act to push the piping loop for a water source heat pump system into a previously drilled hole.

BRIEF DESCRIPTION OF THE DRAWING

The foregoing objects, as well as others, will become apparent through consideration of the following detailed description of the invention given in connection with the accompanying illustrations on the drawings in which.

DETAILED DESCRIPTION OF AN ILLUSTRATIVE EMBODIMENT

Figure 1:
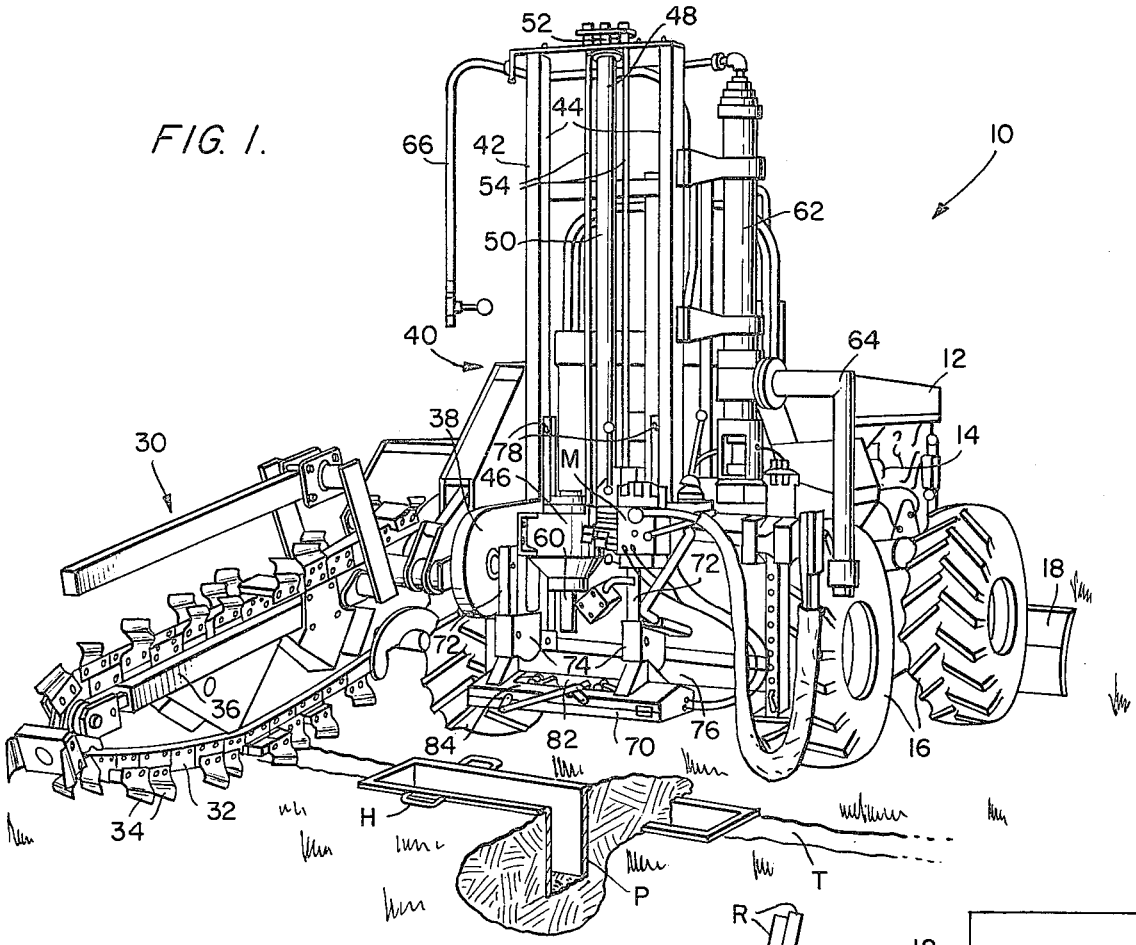
FIG. 1 is a perspective view of the mobile machine of this invention shown positioned relative to a trench previously dug by the machine's trencher preparatory to commencing a vertical rotary drilling operation, certain machine details being omitted for clarity of illustration.

The overall combination of components for the ground supported mobile machine 10 of the invention may best be seen on FIG. 1. These include a tractor vehicle 12 having a power source such as a suitable gasoline or diesel engine 14. The tractor vehicle is illustrated with rubber tired wheels 16 on FIG. 1 although it will be recognized that other configurations of the tractor vehicle as with crawler tracks maybe contemplated within the scope of this invention. It may merely be mentioned that using bar lug flotation tires as illustrated on tractor vehicle 12 offers maximum manuverability, traction and flotation attributes to minimize access problems to restricted areas and damage to cultivated areas such as lawns.

The mobile machine 10 is provided at its forward end with a backfill blade 18. This blade may be power operated from the vehicle power source engine 14 through utilization of hydraulically controlled devices (not shown) as conventionally known in the art. Aside from its utilization in back filling earth in manners known in the art, its power operation is effectively utilized in the instant invention for the transport of a tool box and drill rod section holder 20 in the manner illustrated on FIGS. 2 and 3 of the drawings.

Figure 2:
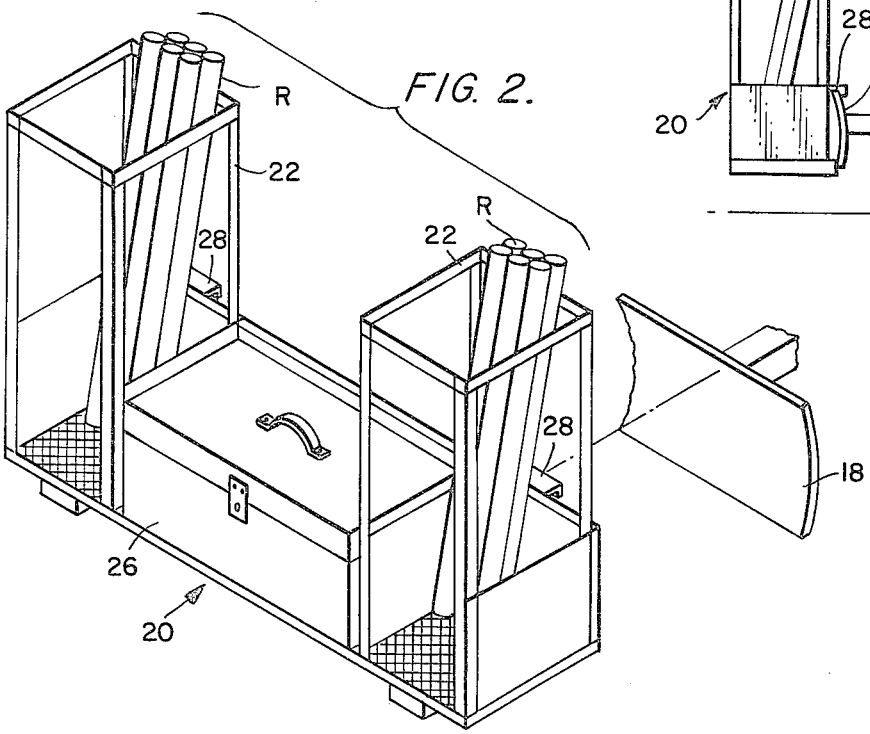
FIG. 2 is a perspective view of the tool box and drill rod holder preparatory to pickup by the backfill blade of the mobile machine of FIG. 1.

In FIG. 2 the holder 20 is shown as made up of a frame providing racks 22 at the opposite ends thereof to conveniently hold a group of sections of drill rods R for their transportation between project sites and make then conveniently available at the site during a drilling operation. The holder 20 also accommodates a tool box 26 supported on the frame between the racks 22, this box providing transportation and ready availability for miscellaneous tools needed in conjunction with a subterranean piping installation project including the several retaining pins, etc. utilized in operating the drilling attachment and its apertenances as will be explained.

Figure 3:
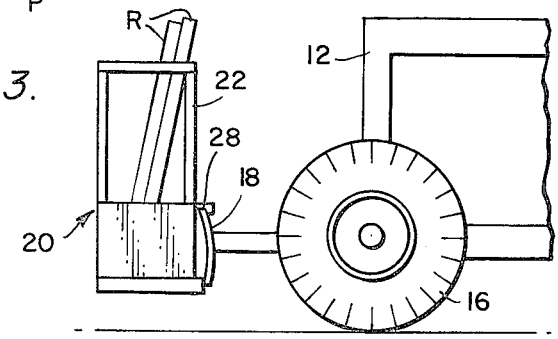
FIG. 3 is a diagramatic view of the tool box and drill rod holder of FIG. 2 engaged with the backfill blade of the mobile machine.

In FIG. 2 the holder 20 is shown with its spaced hooks 28 positioned to engage over the upper edge of the backfill blade 18 on the front end of tractor vehicle 12. FIG. 3 shows the manner in which the hooks 28 on tool and drill rod holder 20 engage with the backfill blade 18 on tractor vehicle 12 in being picked up for transportation on the vehicle between intended rotary drilling operation sites.

Referring again to FIG. 1, the mobile machine 10 has a trencher 30 mounted on the tractor vehicle 12. This trencher is of the digging chain type wherein a chain 32 having spaced digging teeth 34 mounted on the chain links is guided over a boom 36, the boom carrying the digging chain being swung downwardly into the ground about its mounting on the tractor vehicle 12 to carry out a trench digging operation. In such operation the chain 32 is driven to traverse around the length of the boom 36 by a suitable power transmission train 38 powered from the engine 14 of the tractor vehicle 12.

The construction of the trencher 30 and its driving connection to the power source of engine 14 is essentially conventional and thus need not be described in detail herein. Its relationship to the power source provided by engine 14 is diagramatically shown on FIG. 16.

In the structure of the mobile machine 10 as illustrated on FIG. 1, the trencher 30 is mounted laterally to extend longitudinally of one side of the tractor vehicle 12. This mounting relationship on vehicle 12 positions the trencher 30 to be effectively used in digging desired trenches for the project. These may include the mud trench T that retains a supply of drilling mud which is employed in the rotary drilling operation and trenches for piping leading from the vertical drilled hole to the heat pump at the building location. By the lateral mounting of trencher 30 on vehicle 12 the drilling attachment 40 may be centrally mounted adjacent the rear end of the tractor vehicle 12 for convenient and effective performance of a vertical rotary drilling operation at the site of the vertical piping loop that is to form a part of the water source heat pump system.

Before describing the details of the drilling attachment 40, reference will again be made to FIG. 1 and the manner in which the trencher 30 in association with operation of tractor vehicle 12 is employed in digging the trench T shown on this drawing figure. Trench T serves as the mud trench wherein a supply of drilling mud which is circulated down through the drill rod and drill bit in conjunction with the vertical rotary drilling operation is contained. In digging the trench T the tractor vehicle 12 is positioned to align the trencher 30 in the direction that the trench is to be dug. Then the tractor is driven along this digging line with the trencher boom 36 carrying digging chain 32 lowered and the chain driven to perform the desired trenching operation, all in accordance with known procedures utilized in trenching with a tractor-trencher combination such as tractor 12 and trencher 30. Thereafter the trencher 30 is raised relative to the tractor vehicle, the mobile machine 10 reoriented relative to trench T and backed up to the trench T in the relationship shown in FIG. 1.

In FIG. 1 the trencher 30 is in its elevated non-operative position while the drilling attachment 40 mounted on the rear end of the tractor vehicle 12 is positioned to overlie the trench T in preparation for the performance of a vertical rotary drilling operation.

It will be further noted on FIG. 1 that the trench T is preferably provided with a mud pan P. The pan P may be suitably formed of sheet metal providing parallel side walls which lie along the earthen walls of trench T extending for a distance along the trench to preclude the trench walls from collapsing during the drilling operation particularly as collapse might occur by reason of their exposure to circulation of drilling mud within the trench occurring during the drilling operation. The pan P may be of any suitable length, open at its top and bottom to accommodate the drill rod and drill bit in the drilling operation and at least sufficiently open at one or both ends to permit circulation of the drilling mud in trench T in conjunction with the rotary drilling operation. The pan P may be provided with handles H to facilitate its manual placement in trench T and removal therefrom.

Figures 15, 16:
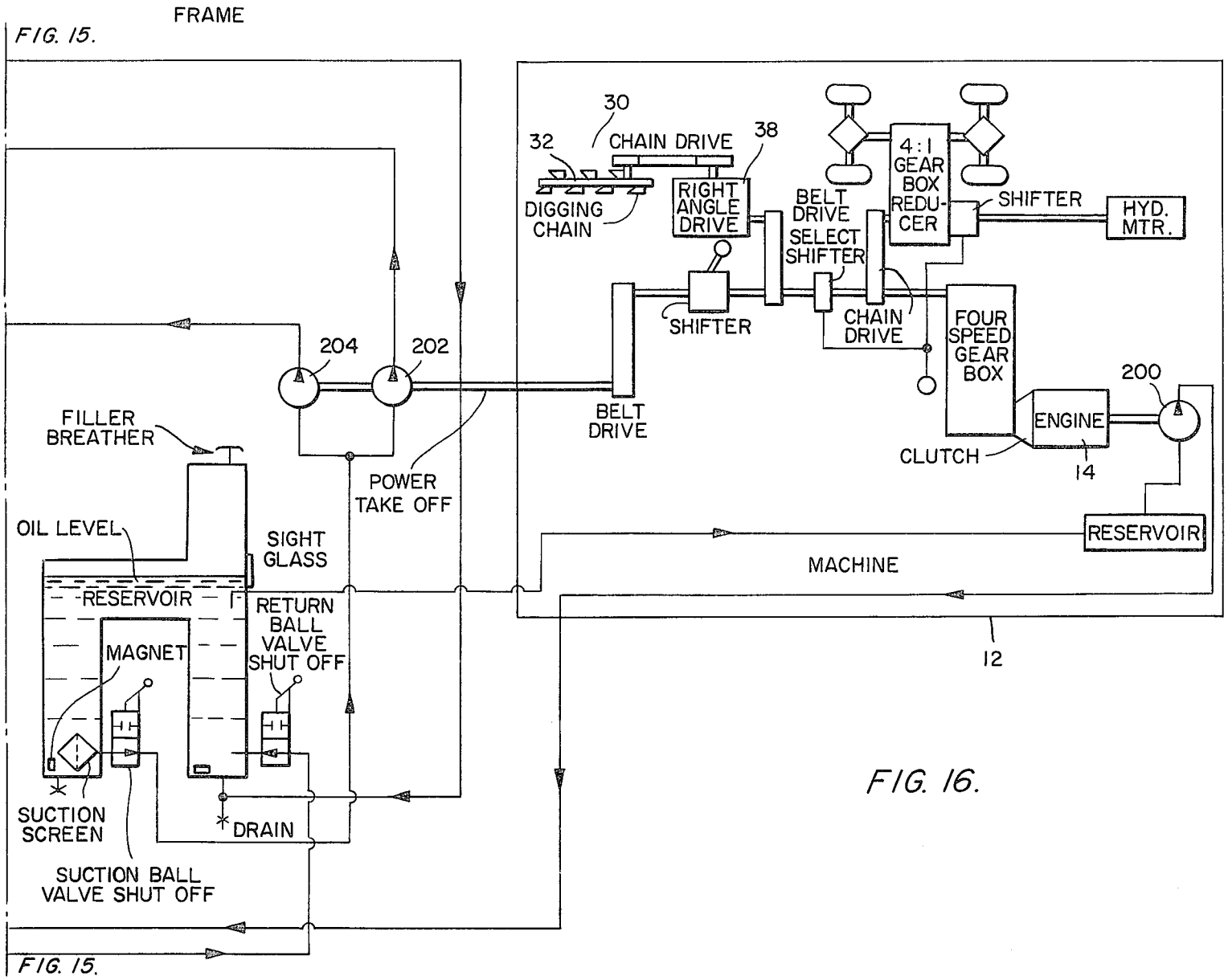
FIG. 15 is a schematic view of a portion of the hydraulic piping diagramatically showing its relationship to components of the mobile machine of FIG. 1.
FIG. 16 is a continuation of the schematic hydraulic piping system of FIG. 15 illustrating components on the tractor vehicle and their interrelation with the drilling attachment frame components.

In connection with a vertical rotary drilling operation utilizing circulating drilling mud retained in trench T, reference may be made to FIG. 15 which shows diagramatically a fairly conventional rotary drilling apparatus. Drilling mud is introduced into the sectional drill rod through a rotary swivel from the mud pump, conducted down the drill rod to the drill bit, thence upwardly through the annular passage around the drill rod into trench T. The mud pump picks up drilling mud from the supply in trench T through the mud pump suction screen for recirculation through the apparatus in removing earth, rock particles, etc. dislodged by drill bit rotation incident the vertical drilling operation.

As shown on FIG. 1, the drilling attachment 40 that is mounted on the rear end of tractor vehicle 12 has a vertical mast 42 providing guide rails 44 for a rotary drill head 46 supported on a carriage that is reciprocated along these guide rails 44. The drill head carriage 46 is reciprocated by a linear hydraulic actuator 48 along the rails 44. The actuator 48 is mounted centrally on mast 42 and may take a form of a cylinder 50 stationarily mounted as part of the mast 42 with its piston rod 52 extending upwardly and connected to the upper ends of guide rods 54. These rods 54 have their lower ends secured to the carriage of the rotary drill head 46.

Drill head 46 provides a vertical drive shaft 60 which, in the drilling operation, is coupled to the drill rod R which has the drill bit drivingly fixed to its lower end. Referring to FIG. 15, it will be understood that, as conventional in rotary earth drilling operations, the drill rod R, as the drilled hole increases in depth, will be lengthened by coupling additional drill rod sections together utilizing the usual threaded joint coupling between sections. Likewise, the drill bit will be threaded onto the lower end of the lowermost drill rod section. The upper end of this sectionalized drill rod R is drivingly connected to vertical drive shaft 60 of the rotary drill head 46. Further, as needed in carrying out the vertical hole drilling, the drill head 46 is reciprocable by linear actuator 48 along the rails 44 of mast 42 to manipulate rod R and its drill bit.

A suitable drive for the rotary drill head 46 is diagramatically illustrated on FIG. 15 and need not be described in detail since it forms no part of the invention. An appropriate hydraulically driven motor coupled through a gear box may be employed to provide the desired direction of rotation of the vertical drive shaft 60 for the drill head 46. The utilization of drilling mud circulation through a rotary swivel disposed in the drill rod R is in accordance with known drilling techniques utilizing drilling mud circulation and description of these techniques need not be given herein. Suffice it to note that an appropriate hydraulically driven mud pump 62 having an intake line 64 and outlet pipe 66 is provided as part of the drilling attachment 40. In FIG. 1 the intake line 64 is not shown with the flexible pipe which would lead from the mud pump suction screen located in trench T and the outlet pipe 66 is not shown with the hose which would lead to the rotary swivel associated with the drill rod, these components being diagramatically illustrated on FIG. 15.

Again referring to FIG. 1, the drilling attachment 40 has a drill table 70 stationarily supported adjacent to the lower end of the vertical mast 42. In FIG. 1 the drill table 70 is shown in its raised position for transportation along with raised trencher 30 on the mobile machine 10. Support for the drill table 70 is shown as suitably provided by parallel upstanding box girders 72 which are slidably received within brackets 74. These brackets may be secured, as by welding, to the frame member 76 of the drilling attachment 40 adjacent the lower end of the vertical mast 42. It will be understood that suitable retaining pins (not shown) may be employed, cooperating with aligned holes in each box girder 72 and its bracket 74, to retain the drill table 70 in its upper position as shown in FIG. 1 or secure it in the lower position of the drill table 70 when the drill table is in operative position disposed immediately above ground level and immediately overlying pan P in trench T to carry out the desired vertical drilling operation.

One of the important functions of the rotary drill head carriage 46 being reciprocable on mast 42 by linear hydraulic actuator 48 is to utilize this movement to raise the rear end of tractor vehicle 12 and drilling attachment 40 to enable the positioning of stabilizing feet laterally of the vertical drilling mast. These stabilizing feet are important to level and firmly support the mobile machine for its performance of the drilling operation. For this purpose the frame member 76 of drilling attachment 40 is provided with mast jack stands 78 adjacent each of its outer ends as shown diagramatically on FIG. 15. The upper ends of these jack stands 78 are then suitably pinned to the rotary drill head carriage 46 to move therewith. For example, when carriage 46 has been raised appropriately from its position shown on FIG. 1 to cooperate with the holes shown at the upper ends of the mast jack stands 78 on FIG. 1 suitable pins (not shown) can be inserted to fixedly couple the stands 78 to carriage 46. With this pinned relationship between the carriage 46 and jack stands 78 the linear hydraulic actuator 48 may be powered to force the carriage 46 downwardly relative to mast 42 thereby lifting the drilling attachment 40 along with the rear end of tractor vehicle 12 while the feet of jack stands 78 rest on the ground generally beneath the drilling attachment 40. Then, suitable stabilizer jacks 80 also associated with frame member 76 may be slid outwardly from the respective ends of frame member 76 to positions as diagrammatically shown on FIG. 15 with the feet of these stabilizer jacks 80 pin connected to frame member 76 so that the feet properly rest on firm ground or an otherwise reinforced surface to stably support the drilling attachment 40 and tractor vehicle 12 in proper level condition for performing the vertical drilling operation.

It will be understood that after proper manual positioning of the stabilizer jacks 80 laterally outwardly of the ends of the frame member 76 the lifting force that had been applied through actuator 48 can be released, the rotary drill head carriage 46 unpinned from the upper ends of mast jack stands 78 leaving the drilling attachment 40 and rear end of tractor vehicle 12 stably supported on the stabilizer jacks 80.

It will be noted that the details of the jack stands 78, stabilizing jacks 80, etc. are omitted from illustration on FIG. 1 to avoid undue complexity in the details sought to be illustrated on this figure. However, the stabilizing techniques used in providing outrigger stabilizing feet for earth working machinery are commonly known and understood and it is not believed that further details relative to this structure need be illustrated or described herein.

After stably supporting drilling attachment 40, the drill table 70 supported on parallel box girders 72 is lowered from its position as shown on FIG. 1 and appropriately pin connected by removable pins (not shown) that fixedly secure each girder 72 in relation to its bracket 74. This results in the drill table 70 being fixedly supported at its operating location immediately above the ground level and overlying the trench T and drilling mud pan P disposed in such trench.

The drill table 70 has a central downwardly tapering opening 82 with a hydraulically actuated slip assembly 84 associated with the opening. The drill table 70 and frame member 76 of the drilling attachment 40 adjacent the lower end of mast 42 also has pipe wrench tongs associated therewith but for clarity of illustration such pipe wrench tongs are omitted from illustration on FIG. 1 while being illustrated in detail on FIGS. 8–10.

Figure 4:
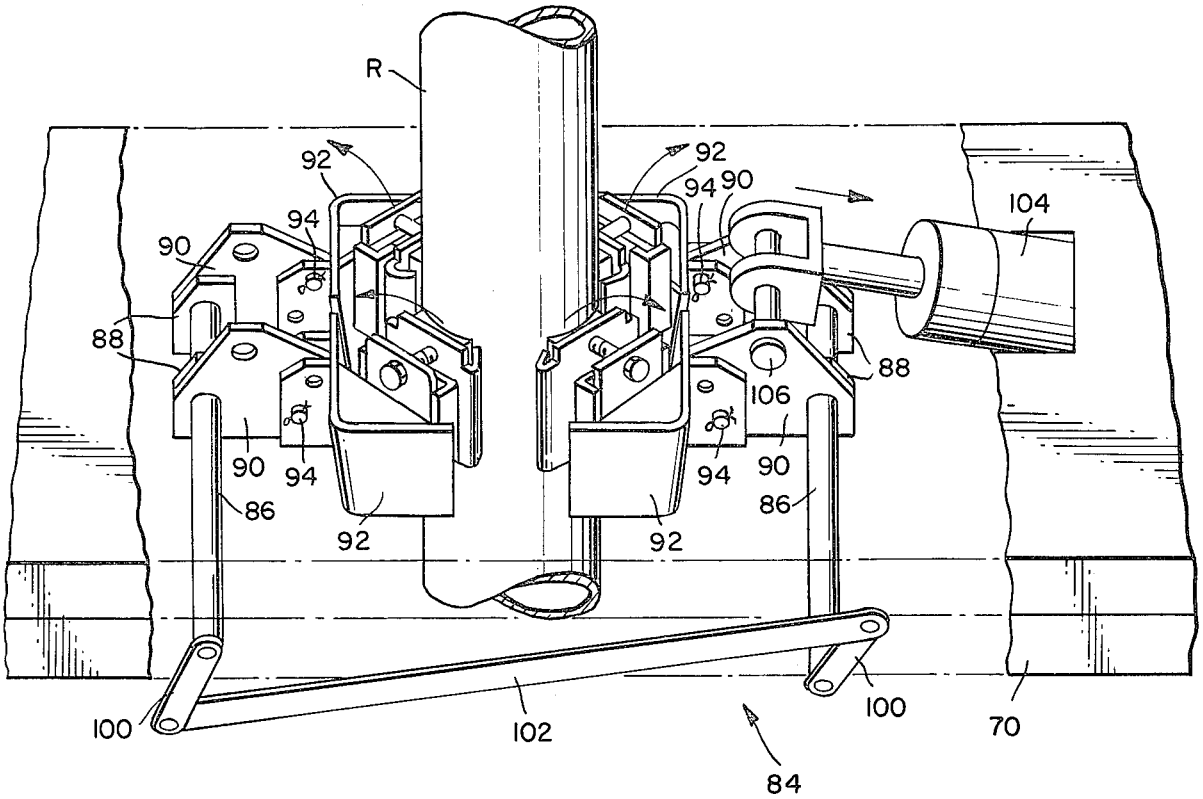
FIG. 4 is a perspective view of the hydraulically actuated slips showing the drilling attachment drill table broken away to illustrate such slip assembly.
Figure 5:
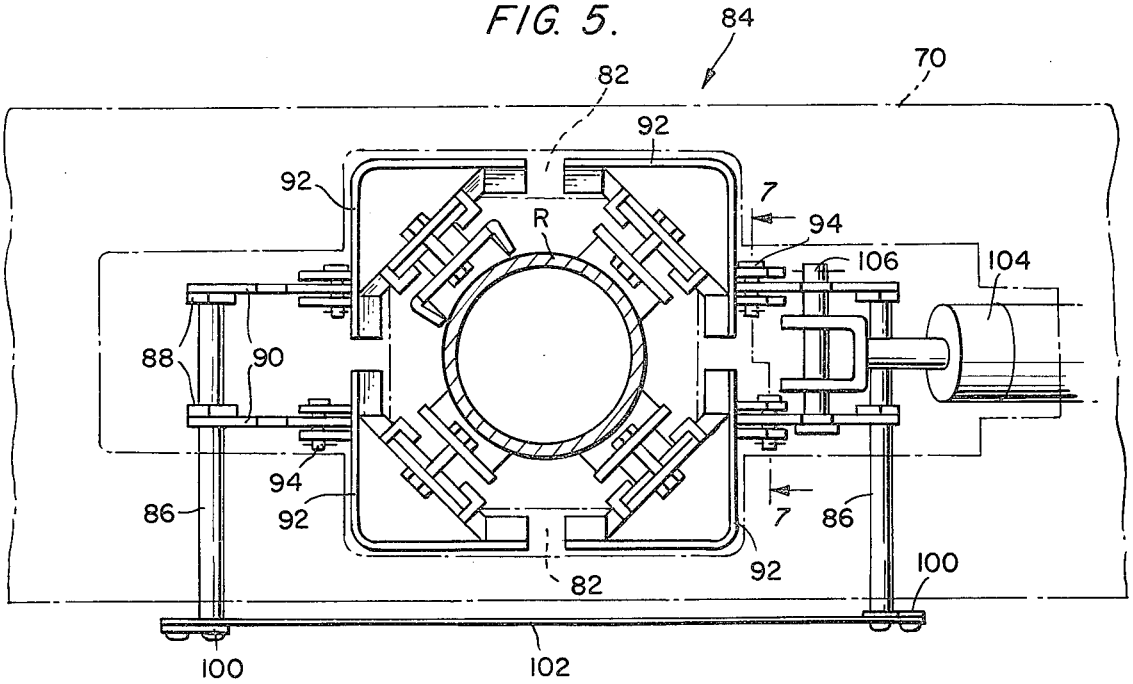
FIG. 5 is a plan view of the slip assembly shown on FIG. 4 with the drill table shown in phantom.

The hydraulically actuated slip assembly 84 that is associated with the tapered opening 82 in drill table 70 is best illustrated on FIGS. 4–7. In FIG. 4 the central section of drill table 70 is shown in phantom to better illustrate the structural details of the hydraulically actuated slip assembly 84. In this assembly, parallel control shafts 86 are pivotally mounted interiorly of the drill table 70 as by means of mounting tabs 88 carried by table 70 and pivotally supporting each control shaft 86. Each control shaft 86 has a pair of attachment brackets 90 fixed to rotate with the shaft. Each attachment bracket 90 has holes pin connected with a slip 92 with the slip facing inwardly toward the center of the tapering opening 82 in drill table 70 (FIG. 5).

The slip assembly 84 is associated with drill table 70 to grippingly engage with a drill rod R and preclude its downward movement while permitting the upward movement of this rod relative to the slips 92. For proper operation of the slip assembly 84 in carrying out this function, the slips 92 are loosely mounted on the attachment brackets 90 by means of pins 94 connecting each slip 92 to its associated attachment bracket 90. Such loose mounting of the slips 92 on brackets 90 by pins 94 may be achieved by the holes for the connecting pin 94 being larger than the pin diameter so as to allow limited movement of the slips 92 relative to their attachment brackets 90. Thus as shown in section on FIG. 7, the holes 96 in each bracket 90 as well as the holes 98 in the slips 92 which are aligned to receive connecting pins 94 are larger in diameter than the diameter of the pin.

Important to operation of slip assembly 84 is the slips 92 being tapered to mate with the downward taper of the opening 82 in drill table 70. Thus the radially outer wall portions of each slip 92 are inclined inwardly so that as the slip moves down along tapered opening 82 it is cammed inwardly toward more firm gripping of a drill rod R, thereby keeping the rod from slipping down through drill table 70.

Similarly, when drill rod R is raised from drill table 70, the slips 92 tend to ride up with the rod so that their inclined wall portions move up to the wider portion of tapered opening 82 thereby relating their grip on the drill rod R. The loose mounting of slips 92 on their attachment brackets 90 facilitates this gripping and releasing action without such action being obstructed or defeated by operation of the linear actuator that controls slip assembly 84.

Figure 6:
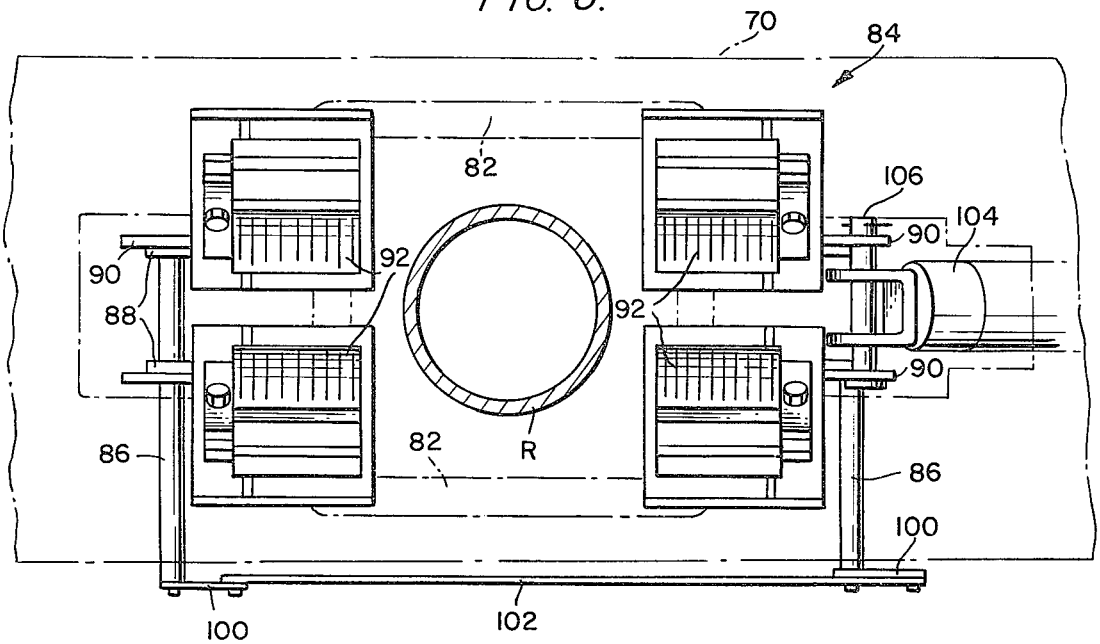
FIG. 6 is a view similar to FIG. 5 but showing the slips in their retracted position.
Figure 7:
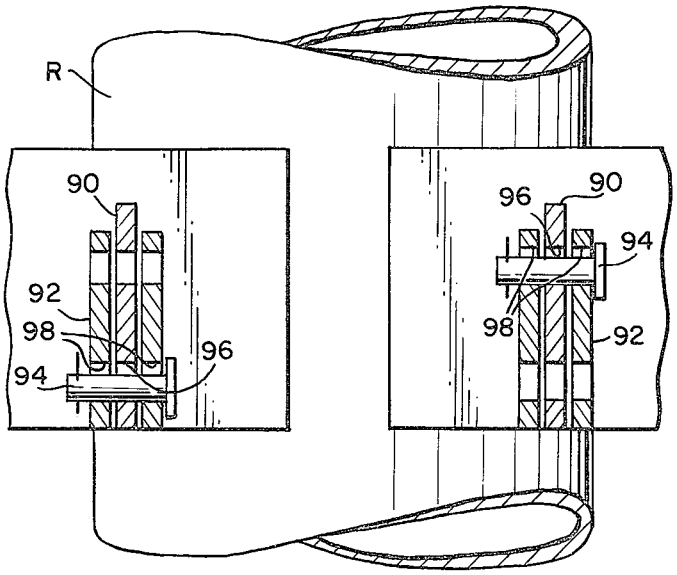
FIG. 7 is a sectional view taken on line 7—7 of FIG. 5.

The actuation of the slip assembly 84 is controlled so that the slips 92 are jointly moved from their operative position as shown on FIGS. 4 and 5 where they can grippingly engage with a drill rod R to their inoperative position as shown in FIG. 6, remote from the tapered drill table opening 82 and drill rod R. This coordinated operation of the slips 92 is effected through the rotating movements of control shafts 86.

Thus each control shaft has a link 100 fixed to its outer end and a tie link 102 pivotally connecting the free ends of these links 100. As may most easily be seen on FIG. 4, with the links 100 generally extending in opposite directions from the control shaft 86 to which they are fixed and the tie link 102 extending diagonally between the free ends of links 100, the rotation of one control shaft 86 in a clockwise direction will, through the linkage means, compel the other control shaft 86 to rotate in a counter clockwise direction.

This desired movement of the control shafts 86 to move the slips 92 from their operative position to their inoperative position is achieved by a linear hydraulic actuator 104 having its cylinder fixed to drill table 70 and its piston connected by pin 106 to the pair of attachment brackets 90 at one side of drill table opening 82 which are in turn fixedly secured to rotate with the control shaft 86 at that side of the drill table opening 82. It will thus be recognized that as linear actuator 104 is extended to the position shown in FIGS. 4 and 5, the slips 92 will be moved to their operative position to grippingly engage with the drill rod R while contraction of linear actuator 104 to the position shown on FIG. 6 will effect movement of the slips 92 to their inoperative position remote from drill rod R, effectively clearing the drill table 70 opening for needed manipulation of the drill rod and drill bit in carrying out the rotary drilling operation.

In addition to the above described hydraulically actuated slip assembly 84, the drilling attachment 40 and drill table 70 have pipe wrench tongs associated therewith, such tongs being operable to break free a threaded joint between drill rod sections or the threaded joint between a drill rod section and the drill bit. This tongs means is provided by a lead tong 110 that is operated by a hydraulic linear actuator and a backup tong 112. The relationship of these pipe wrench tongs to the drill table 70 and frame member 76 of the drilling attachment 40 is illustrated on FIG. 8, with FIG. 9 showing details of the lead tong 110 and FIG. 10 showing details of the backup tong 112.

Figure 8:
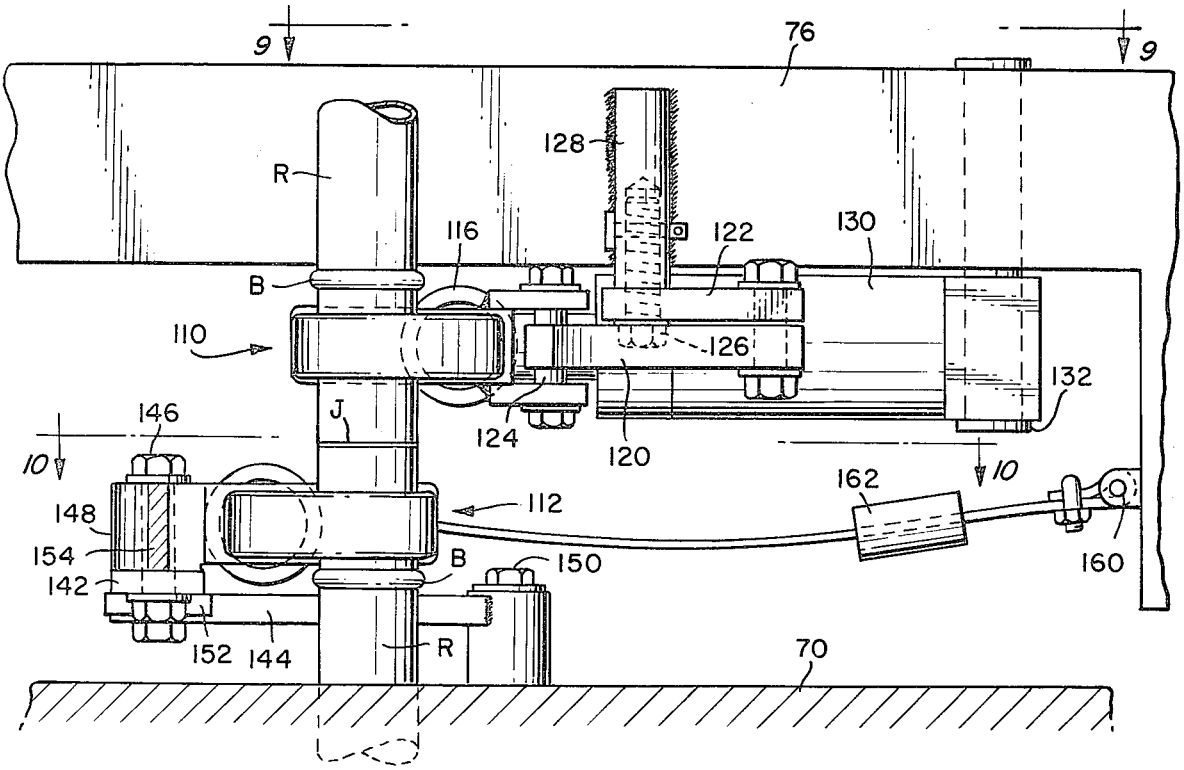
FIG. 8 is an elevational view of the pipe wrench tongs associated with the diagramatically illustrated drill table and a drilling attachment frame member.

It is to be understood that commercially available pipe wrenches are employed in constructing the pipe wrench tongs 110 and 112. Their purpose and function as viewed in FIG. 8, is for the backup pipe wrench tong 112 to grip the drill rod R beneath joint J while lead pipe wrench tong 110 grips the drill rod R above threaded joint J. Then while pipe wrench tong 112 holds the drill rod section beneath the joint J against rotation, the lead pipe wrench tong 110 grips the drill rod above joint J and is turned by the linear hydraulic actuator to break free the threaded joint J.

It may be noted that a projecting weld bead B may be provided circumferentially on each drill rod section R adjacent the section end so that in manipulation of the pipe wrench tongs 110 and 112 to break free the threaded joint J, the drill rod will not freely slip through the jaws of the pipe wrenches.

Figure 9:
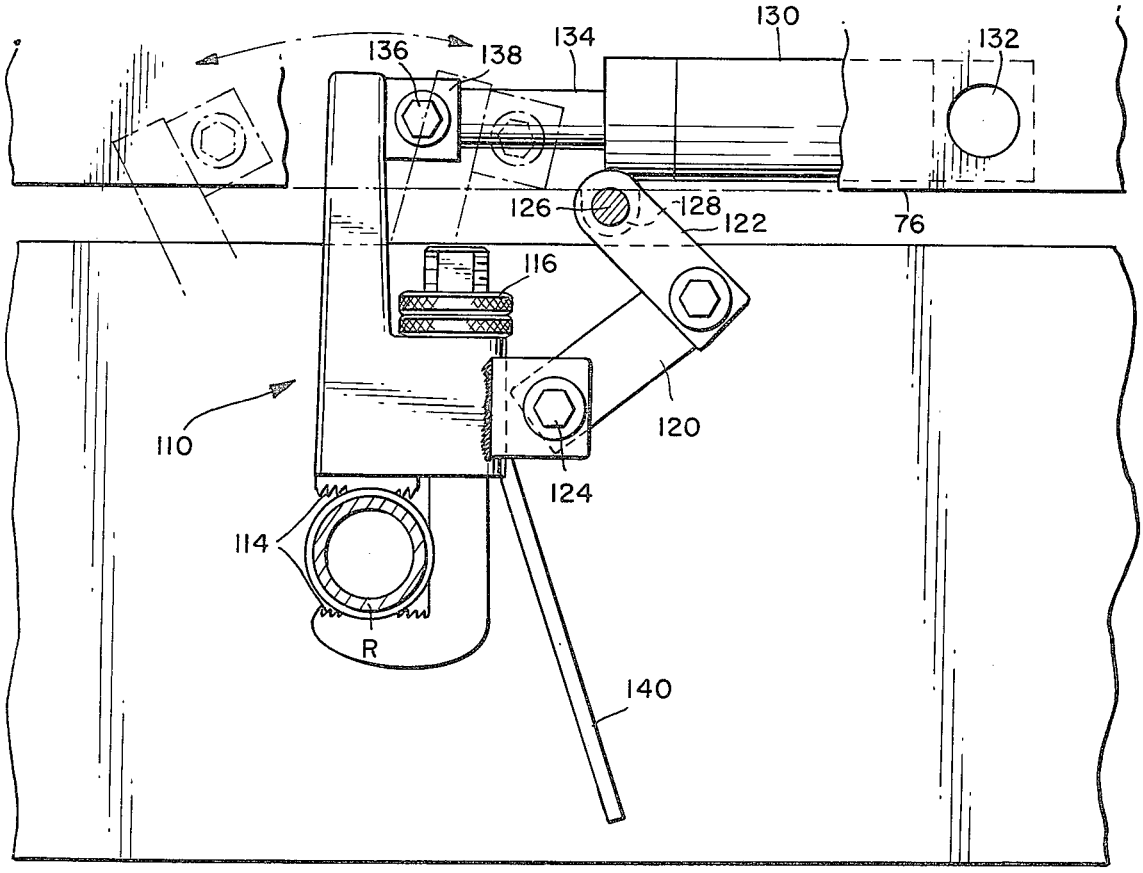
FIG. 9 is a view taken on line 9—9 of FIG. 8 showing the lead pipe wrench tong pivotally supported on the drilling attachment frame member.
Figure 10:
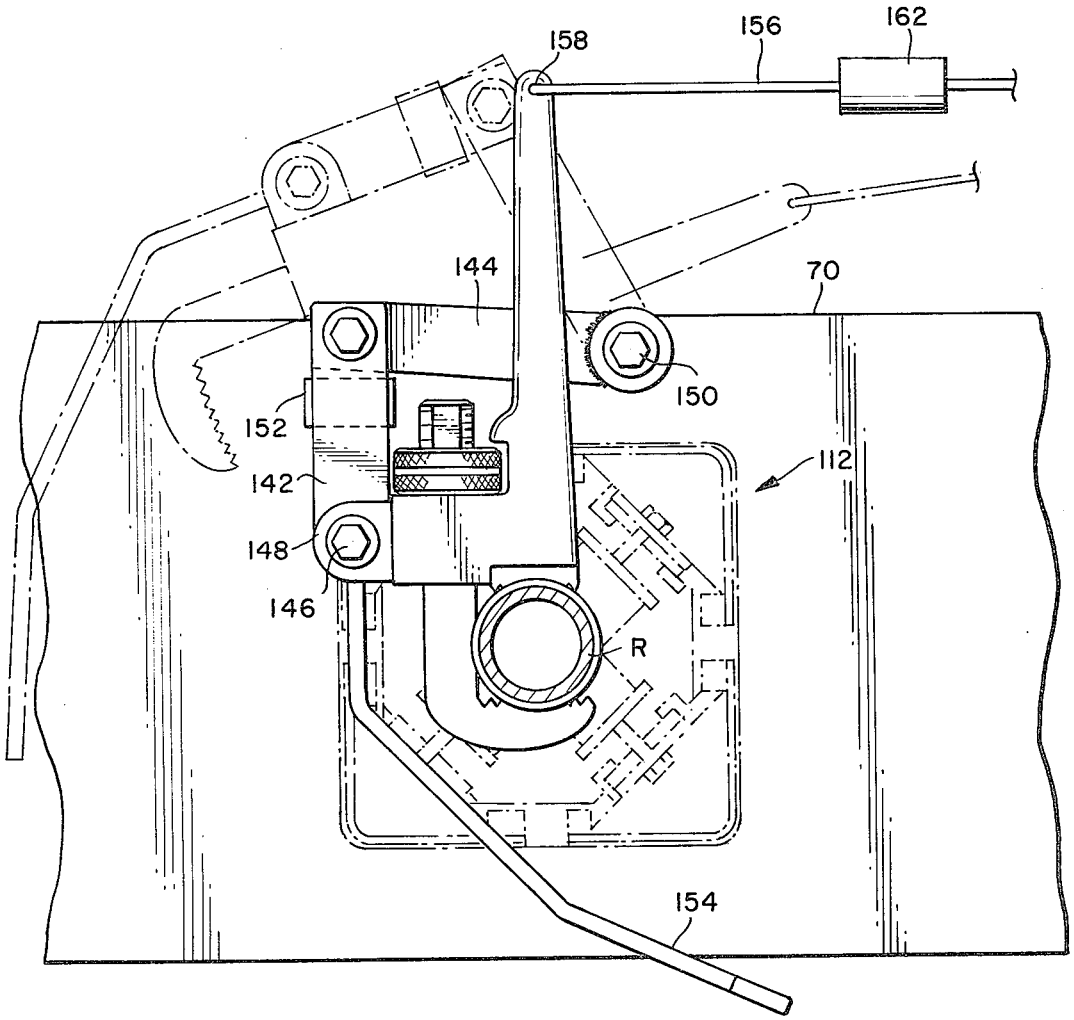
FIG. 10 is a view taken on line 10—10 of FIG. 8 showing the backup pipe wrench tong pivotally mounted on the drill table of the drilling attachment with the slip assembly partially shown in phantom outline.
Figure 11:
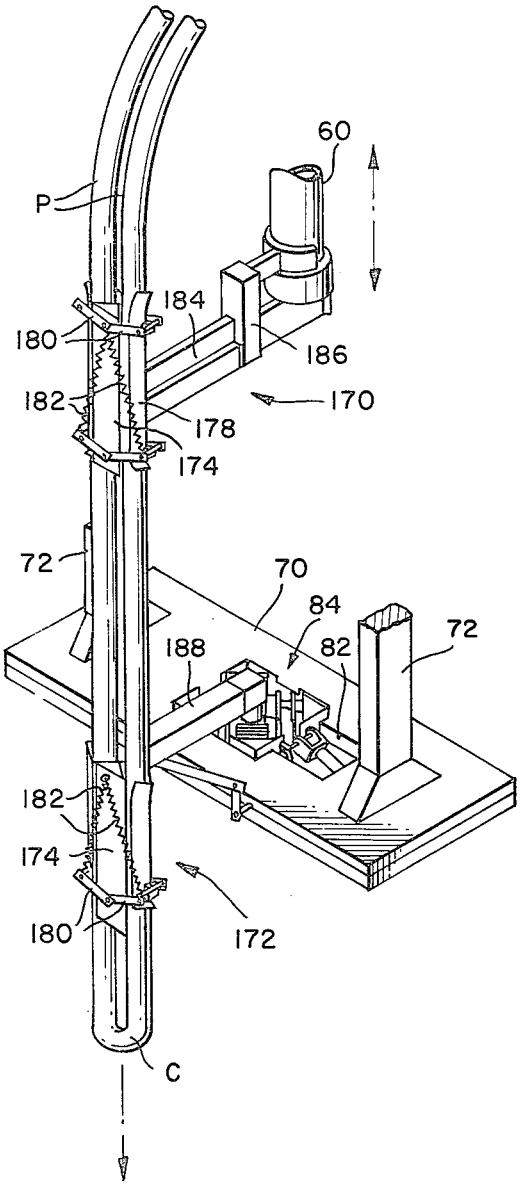
FIG. 11 is a perspective view showing the pipe pusher with its upper piping clamp attached to the rotary drill head carriage and lower piping clamp attached to the drill table of the drilling attachment.
Figure 12:
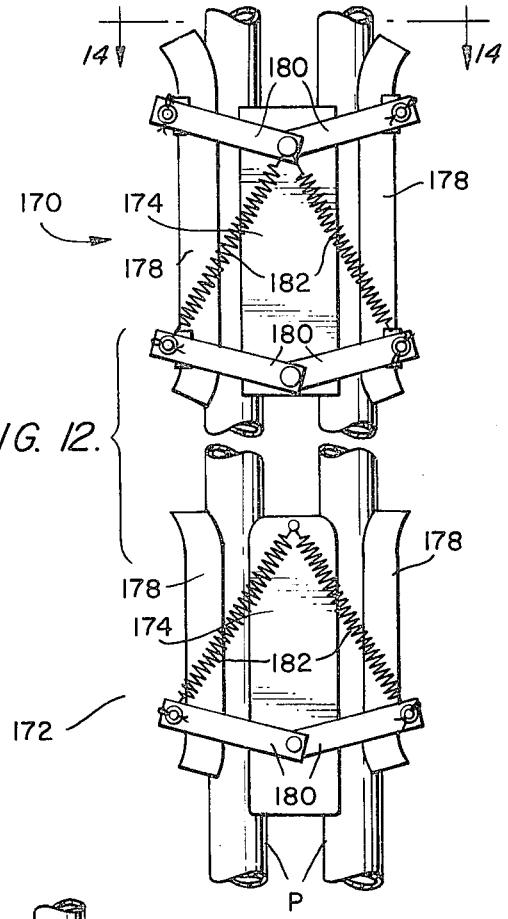
FIG. 12 is an elevational view of the upper and lower piping clamps for the pipe pusher shown in FIG. 11.
Figure 13:
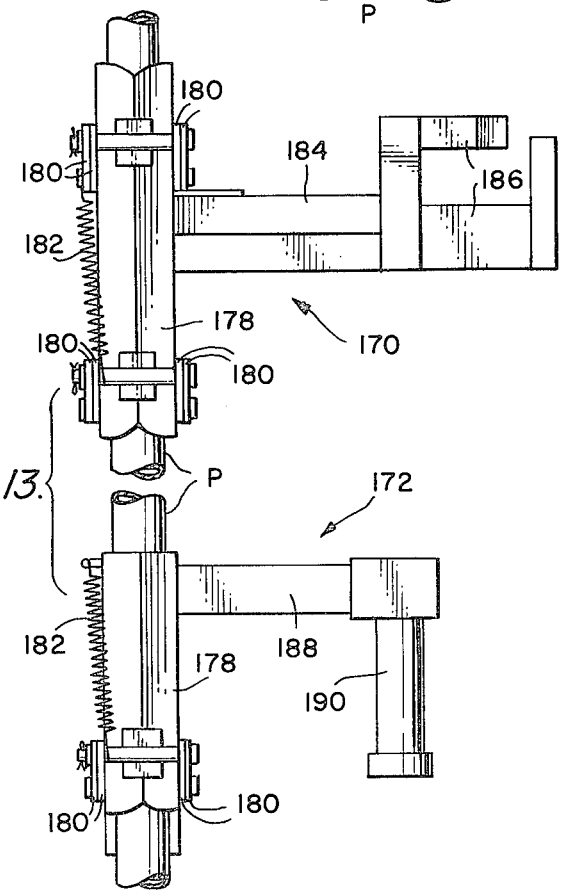
FIG. 13 is a side elevational view of the pipe pusher shown in FIG. 12.
Figure 14:
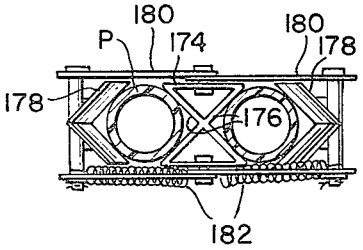
FIG. 14 is a sectional view taken on line 14—14 of FIG. 12.

Referring to FIGS. 8 and 9 for description of the pipe wrench tong 110, it will be seen that a standard conventional pipe wrench having gripping jaws 114 and a conventional adjusting ring nut 116 for altering the jaw opening to accommodate different diameter drill rod R is supported on a pair of pivotally interconnected links 120 and 122. The free end of link 120 is pivotally secured at 124 to the body of the pipe wrench forming lead tong 110 while the free end of link 122 is pivotally secured by bolt 126 threaded into a sleeve 128 welded on to the frame member 76 of the drilling attachment 40. This linkage provided by pivotally interconnected links 120 and 122 permits the pipe wrench tong 110 to swing clear of the drill table opening 82 as is desirable during the performance of a rotary drilling operation. By the same token, the linkage permits tong 110 to swing into a position as shown on FIGS. 8 and 9 where the wrench jaws 114 generally overlie the center of the tapered drill table opening 82 in position to grippingly hold the drill rod section R against rotation.

A linear hydraulic actuator 130 has its cylinder fixed by a pin 132 to the frame member 76 of the drilling attachment 40 and its piston rod 134 pivotally connected at 136 to the handle portion of the body of the pipe wrench as by bracket 138 welded to such handle portion. Thus as shown in the phantom positions for pipe wrench tongs 110, extension of linear actuator 130 moves the tongs to assume an initial gripping position on drill rod R. Thereafter contraction of actuator 130 acts to turn the drill rod R while gripped by pipe wrench tong 110.

Although omitted from FIG. 8 for clarity in illustration, FIG. 9 shows a handle 140 fixed to the body of the wrench forming tong 110. Handle 140 by extending forwardly above the drill table 70 to be readily accessible to the operator of the drilling attachment 40 enables easy manipulation of the pipe wrench tong 110 to swing it into its gripping position for the drill rod R as well as facilitate its being swung on the linkage provided by links 120 and 122 clear of the drill table opening 82 when a rotary drilling operation is being formed necessitating manipulating the drill rod sections and drill bit relative to the opening 82 in drill table 70.

Reference may be made to FIGS. 8 and 10 with respect to the pipe wrench tong 112 which forms the backup tong for the pipe wrench tong means of the invention. Backup tong 112 utilizes a standard pipe wrench swingably mounted on linkage provide by link 142 pivoted to link 144 with the free end of link 142 pivotally connected by bolt 146 to bracket 148 welded to the body of the pipe wrench forming backup tong 112. In turn, the free end of link 144 is pivoted on bolt 150 which is secured to the surface of drill table 70. Adjacent the pivotal connection between links 142 and 144 there is provided a suitable stop 152. This stop is beneficial in limiting pivoting movement between links 142 and 144 so that when backup tong 112 is swung to its out of the way position clear of the opening 82 in drill table 70 the entire tong 112 on the linkage made up of links 142 and 144 will assume the phantom line position as shown on FIG. 10.

Pipe wrench tong 112 may be provided with a suitable handle 154 fixed to the bracket 148 that is welded to the body of the pipe wrench. This handle 154, like the above described handle 140 on pipe wrench lead tong 110, makes for ease in manipulating the pipe wrench tong 112 in swinging it into position where the wrench jaws generally overlie the center of the drill table opening 82 to grippingly hold a drill rod section against rotation and thereafter free the pipe wrench grip from the drill rod R for it to swing to its second position where the wrench is clear of the opening in drill table 70.

The backup pipe wrench tong 112 is provided with a restraining means which acts to limit its swinging movement so that it can effectively perform its intended function of grippingly holding the drill rod R against rotation while the lead pipe wrench tong 110 is being rotated by linear actuator 130 to turn the drill rod section that it grips and thereby break free the threaded joint J between the drill rod sections. This restraining means is provided by flexible cable 156 having one end secured at 158 to the end of the handle of pipe wrench tong 112 while the opposite end is affixed as at 160 to a suitable stationary portion of the drilling attachment 40 such as a part of the frame member 76 as shown on FIG. 8. With the restraint provided by cable 156 it will be seen that the pipe wrench tong 112 is prevented or limited from swinging beyond the position shown on FIG. 10. It thus effectively performs its function of grippingly holding the drill rod R against rotation.

Once the holding function of pipe wrench tong 112 has been performed it is desired for this tong to be swung back out of the way from the drilling table to perform a drilling operation. Accordingly, the cable 156 is provided with a weight 162. Thus when the handle 154 on the pipe wrench tong 112 has been manually or otherwise moved to free the wrench from drill rod R the weight on cable 156 acts to apply tension on the cable so as to draw the wrench back into its position shown in phantom lines on FIG. 10. During this action it will be recognized that the stop 152 keeps links 140 and 144 of the linkage that mounts the backup tong 112 in proper relation to each other so that the tongs swing to the phantom line position of FIG. 10.

When a vertical rotary drilling operating has been completed the mobile machine of this invention is constructed to be effectively usable in pushing the piping loop which is to become a part of the water source heat pump system into the drilled hole. Normally, plastic piping is employed for this purpose consisting of parallel pipes connected at their lower ends by a U or other suitable connection C such that the liquid supply for the heat pump will be circulated, for heat exchange with the earth, down one length of piping, through the U and up through the other length of piping. It is thus important that the mobile machine have the capability of pushing this piping into the drilled hole.

In performing this operation, the machine 10 is moved slightly forward from its position as depicted on FIG. 1 so that the rotary drill head 46, its drive shaft 60 and drill table 70 no longer overlie the drilled hole which now extends downwardly from the bottom of trench T.

The mechanism for carrying out the pipe pushing operation in conjunction with certain components provided on the drilling attachment 40 is illustrated on FIGS. 11–14. This mechanism is not in place in the showing on FIG. 1 for clarity in illustrating the mobile machine on FIG. 1 but is associated with the drilling attachment 40 and drill table 70 components incident carrying out the pipe pushing operation.

Basically, the pipe pusher is comprised of an upper piping clamp 170 which is releasably attachable to the rotary drill head carriage 46 and a lower piping clamp 172 which is releasably attachable to the drill table 70. For example, the upper clamp 170 can conveniently be connected to the vertical drive shaft 60 of the rotary drill head carriage 46 and suitably secured relative to the carriage to assure that the clamp projects rearwardly from carriage 46 to only partake of movement with the carriage in its vertical reciprocating path under control of the linear hydraulic actuator 48. Similarly, the lower piping clamp 172 may conveniently be releaseably attached to the drill table 70 by utilizing the hydraulically actuated slip assembly 84 present on the drill table as described hereinabove.

The pipe pusher consisting of upper clamp 170 and lower clamp 172 is employed in pushing piping P into the hole previously drilled through utilization of the drilling attachment 40. In the herein above mentioned utilization of the mobile machine 10 for the installation of water source heat pump systems and specifically installing a vertical closed loop to be connected to the heat pump of such a system, the closed loop may have the configuration shown on FIG. 11. Semi-flexible plastic piping can be used to form parallel lengths of piping P joined at their lower end by a connecting portion C. The lower clamp 172 that is fixed to the stationary drill table 70 serves to guide the piping while the upper clamp is gripping the piping P and moving downwardly under force applied through the carriage 46 actuated by linear actuator 48. Then the lower clamp 172 holds the piping P against forces tending to float it up out of the drilled hole while the upper clamp 170 is rising by upward movement of the carriage 46 and during such movement sliding along the piping P. Upon reaching its upper position, the clamp 170 can be moved downwardly by the driving force of carriage 46 with the clamp regripping the piping P to push another length of such piping into the vertical drilled hole.

The piping clamps 170 and 172 are similar in construction although they differ in the structure of the attaching bracket used for their attachment to the carriage 46 of the drilling attachment 40 or stationary drill table 70.

Each piping clamp has a central inside shoe 174 providing oppositely facing channels 176. An outside shoe 178 is spaced outwardly of each of the channels 176 and connected to the central shoe 174 by links 180, these links being pivotally connected at their ends to the central shoe 174 and outside shoe 176 so that a pair of passages are located between the outwardly facing channels 176 and the inner longitudinal surfaces of the outside shoes 178. The parallel lengths of piping P are received in these passages for the clamps 170 and 172 to carry out the pipe pushing operation.

Springs 182 are connected betwen the central inside shoe 174 and each of the outside shoes 178 to urge each outside shoe upwardly relative to the central shoe, pivoting on links 180, so that the outside shoes are biased toward the channels 176 to hold the piping P in the passages of the clamps during the pipe pushing operation. It will be noted that upper piping clamp 170 is provided with two sets of links 180 and two springs 182, this giving clamp 170 a parallelogram linkage configuration whereby the outside shoes 178 can most effectively grip the piping P when downward pressure is applied to the central shoe 174 through its attaching bracket which releasably attaches it to the rotary drill head carriage 46.

The upper piping clamp 170 includes an attaching bracket provided by arm 184 integral therewith and extending rearwardly from central inside shoe 174. The end of arm 184 is provided with a bracket 186 suitably configured to be releasably attached to the rotary drill head carriage 46 as by attaching bracket 186 to vertical drive shaft 60 and/or other portions of the carriage 46 to securely mount the upper clamp 170 to move vertically with carriage movements.

The attaching bracket for lower piping clamp 172 is provided by an arm 188 that is integral with and extends rearwardly from the central inside shoe 174 of clamp 172. Arm 188 has a stub shaft 190 fixed to the end thereof to extend downwardly parallel to central shoe 174 of clamp 172. Stub shaft 190 can have a thickness dimension generally corresponding to the diameter of a drill rod R. By stub shaft 190 having this dimension the lower piping clamp 172 may be conveniently fixedly secured to the drill table 70 through utilization of the hydraulically actuated slip assembly 84. Thus with the slip assembly closed onto stub shaft 190 so that the grooved slips grip such shaft, the lower clamp 172 is firmly and properly positioned for the upper clamp 170 and lower clamp 172 to be disposed as shown on FIG. 13 to perform the pipe pushing operation.

Reference may now be made to the schematic showing on FIGS. 15 and 16 of certain of the more important features included in the hydraulic system employed with the mobile machine 10 for operating control of the machine's various components. It may be mentioned that FIG. 16 is a continuation of the hydraulic schematics shown on FIG. 15. Detailed description of the two figures should not be necessary since the legends on the figures are to a large extent self explanatory and further, where appropriate, reference numerals identifying components of the machine structure that have been described hereinabove appear on FIGS. 15 and 16.

The box on the right hand portion of FIG. 16 generally represents the tractor vehicle 12 which carries the power source in the form of engine 14 and trencher 30 including its digging chain 32. The left portion of FIG. 16 schematically illustrates portions of the frame for drilling attachment 40 while the right portion of FIG. 15 schematically depicts hydraulic control valves, pressure gages, etc. which for the most part are associated with the manifold M that is mounted at the rear of the drilling attachment 40 convenient to the machine operator as shown on FIG. 1. The left portion of FIG. 15 diagramatically illustrates several of the actuator components along with schematic illustration of the hydraulics involved with these components.

The power source engine 14 on tractor vehicle 12 provides power for all needed operations of the mobile machine 10. In utilizing the engine power under the specific embodiment illustrated, the engine 14 is coupled to drive a hydraulic pump 200 with the pump output being supplied to operate the mast cylinder which is linear hydraulic actuator 48 that reciprocates rotary drill head carriage 46 as shown at the left of FIG. 15 and as heretofore described with reference to FIG. 1. As will be understood the controlled movements of the mast cylinder are effected by appropriate control of hydraulic fluid flow through utilization of standard hydraulic valves as illustrated on FIG. 15.

The tractor vehicle 12 also has a power take off shaft leading from the vehicle to the drilling attachment frame where the shaft is coupled to drive two hydraulic pumps 202 and 204. In the embodiment shown pump 202 supplies hydraulic fluid to drive a hydraulic motor for the drill head 46 that rotates drive shaft 60 in the appropriate direction to carry out the vertical drilling operation while hydraulic pump 204 supplies driving hydraulic fluid to a hydraulic motor which is coupled to drive the mud pump 62.

The hydraulic pump 200, driven from the engine 14 on tractor vehicle 12, also supplies hydraulic fluid under pressure for appropriate actuation in carrying out the vertical drilling operation of the slips cylinder (104 on FIGS. 4–6) and the wrench cylinder (130 on FIGS. 8 and 9). Again, appropriate hydraulic valving is employed in the hydraulic circuit to control these components as they are associated with the drilling attachment 40 and its drill table 70.

Brief summary of the procedural steps carried out in performing a vertical drilling operation may be given, noting that digging the trench T utilizing trencher 30 on tractor vehicle 12 and manipulating the piping clamps 170 and 172 in performing the pipe pushing operation with the components of FIGS. 11–14 after the vertical hole is drilled have both been described hereinabove with reference to the components involved in carrying out these two operations.

After the stabilizing jacks 80 have been appropriately positioned through utilization of the mast jack stands 78 in the manner hereinabove described so as to level the tractor vehicle 12 for the vertical drilling operation, the drill table 70 is lowered to closely overlie the mud trench pan P in trench T with its box girders 72 pinned to their respective brackets 74.

The drill bit is threaded onto the lower end of a drill rod R and with the carriage 46 elevated this drill rod is drivingly coupled to the drive shaft 60. A rotary swivel supplied with drilling mud from line 66 leading from mud pump 62 is coupled to feed the mud into the drill rod and the bit. Then the rod R and drill bit are lowered through the opening 82 in drill table 70 down into the bottom of trench T adjacent the bottom of mud pan P. This lowering of rotary drill head carriage 46 is completed through hydraulic control of linear hydraulic actuator 48. Thereupon the drill shaft 60 is rotated to commence drilling.

It will be recognized that the procedures used in performing the rotary drilling operation, involving adding drill rod sections as drilling progresses and removing such sections to extract the drill stem from the drilled hole will advantageously use the slip assembly 84 under control of hydraulic actuator 104 and pipe wrench tongs 110 and 112 under control of hydraulic actuator 130 to hold the drill rod R, break free the threaded joint between adjacent drill rod section ends and manipulate the drill rod carrying the drill bit by vertical reciprocating movements of carriage 46 under control of hydraulic actuator 48, all in accordance with techniques and procedures recognized as employed in well drilling operations. With the drill table 70 in operative position it may be desirable to center the drill rod R relative to opening 82 by using wedge blocks (not shown) which fill the opening 82 but leave a circular bore for rod R within which the rod R can partake of guided rotation during hole drilling.

It should be appreciated from the above disclosure of the invention that the mobile machine with its combination of earth working components has a variety of advantageously useful applications. While the mobile machine may find particular applicability in the installation of closed piping loops that are to be connected with water source heat pumps in water source heat pump systems, it will be recognized that the machine is subject to utilization in a multitude of environments other than in conjunction with installing water source heat pump systems.

Further, it is to be understood that the mobile machine construction of the invention herein shown and described must be taken only as a preferred representation of the invention. Various changes and modifications in the arrangement of the components, parts, units, elements, etc. may be resorted to without departing from the disclosure of the invention or the scope of the appended claims.

We claim:

1. A ground supported mobile machine adapted for subterranean installation of piping and the like comprising:

a tractor vehicle having a power source to propel the vehicle;

a drilling attachment mounted on said vehicle having a vertical mast providing guide rails, a carriage supporting a rotary drill head reciprocably mounted on said guide rails and a linear hydraulic actuator coupled between said mast and said carriage to drive said carriage along said rails, said rotary drill head providing a rotatable drive shaft to be coupled to a drill rod and bit in performing a rotary drilling operation;

a drill table fixedly supported adjacent the lower end of said mast providing an opening to accommodate drill rod and bit manipulations in performing a drill operation;

hydraulically actuated slip means associated with said table opening to grippingly engage with a drill rod to preclude downward rod movement while permitting upward movement of the rod relative to such slip means; and pipe wrench tong means operable to break free a threaded joint between drill rod sections or between a rod section and the drill bit;

a power operated backfill blade mounted on said vehicle connected to be operated by said vehicle power source; and a tool and drill rod holder, said holder having hook means engagable with a portion of said back fill blade to enable picking up said holder for transportation of tools and drill rod sections on said vehicle to an intended drilling operation site.

2. A mobile machine as recited in claim 1 wherein said holder includes a frame providing drill rod rack means and tool box means, and said hook means includes spaced hooks on said frame engagable over the upper edge of said backfill blade to support said holder on the blade for transportation by said tractor vehicle.

3. A ground supported mobile machine adapted for subterranean installation of piping and the like comprising:

a tractor vehicle having a power source to propel the vehicle;

a drilling attachment mounted on said vehicle having a vertical mast providing guide rails, a carriage supporting a rotary drill head reciprocably mounted on said guide rails and a linear hydraulic actuator coupled between said mast and said carriage to drive said carriage along said rails, said rotary drill head providing a rotatable drive shaft to be coupled to a drill rod and bit in performing a rotary drilling operation;

a drill table fixedly supported adjacent the lower end of said mast providing an opening to accommodate drill rod and bit manipulations in performing a drill operation;

hydraulically actuated slip means associated with said table opening to grippingly engage with a drill rod to preclude downward rod movement while permitting upward movement of the rod relative to such slip means;

pipe wrench tong means operable to break free a threaded joint between drill rod sections or between a rod section and the drill bit;

said drilling attachment further including pipe pushing means having upper piping clamp means releasably attachable to said carriage to move therewith in pushing piping into the drilled hole and lower piping clamp means releasably attachable to said drill table to guide and hold the piping during the pipe pushing operation; and each of said pipe clamping means including a central inside shoe providing oppositely facing channels and an outside shoe spaced outwardly of each said channel, link means pivotally connecting each outside shoe to said central inside shoe whereby a pair of passages are provided by said channels and said outside shoes to receive piping to be pushed into the drilled hole, and biasing means acting between said central shoe and each outside shoe to urge said outside shoes toward said central shoe to hold piping disposed in said passages during the pipe pushing operation.

4. A mobile machine as recited in claim 3 wherein said biasing means comprises spring means connected between said central inside shoe and each of said outside shoes to urge said outside shoes upwardly relative to said central shoe.

* * * * *